US006199922B1

(12) United States Patent
Kibble

(10) Patent No.: US 6,199,922 B1
(45) Date of Patent: Mar. 13, 2001

(54) LATCH UNIT AND ASSEMBLY, AND METHOD OF OPERATING A LATCH UNIT

(76) Inventor: Anthony Wilfred Kibble, 8 Oak Park Court, Walsall Road, Sutton Coldfield (GB), B74 4QY ( * ) Notice: Subject to any disclaimer, the term of this patent is extended or adjusted under 35 U.S.C. 154(b) by 0 days.

(21) Appl. No.: 09/214,554

(22) PCT Filed: Jul. 4, 1997

(86) PCT No.: PCT/GB97/01815

§ 371 Date: May 10, 1999

§ 102(e) Date: May 10, 1999

(87) PCT Pub. No.: WO98/01641

PCT Pub. Date: Jan. 15, 1998

(30) Foreign Application Priority Data

Jul. 4, 1996 (GB) ..... 9614020

(51) Int. Cl.[7] ..... E05C 1/06

(52) U.S. Cl. ..... 292/140; 292/169.14; 292/DIG. 24; 292/DIG. 52

(58) Field of Search ..... 292/140, 163, 292/169, 169.14–169.18, DIG. 24, DIG. 52; 70/150

(56) References Cited

U.S. PATENT DOCUMENTS

| | | | | |
|---|---|---|---|---|
| 47,349 | * | 4/1865 | Walker | 292/140 |
| 720,455 | | 2/1903 | More . | |
| 895,174 | | 8/1908 | Edey . | |
| 1,301,979 | | 4/1919 | Schonwald . | |
| 1,325,919 | | 12/1919 | Voight . | |
| 1,359,347 | | 11/1920 | Fleisher . | |
| 1,462,828 | | 7/1923 | Rixson . | |
| 1,544,319 | * | 6/1925 | Hoffman | 70/150 |
| 1,626,384 | * | 4/1927 | Boge | 70/150 |
| 1,636,868 | * | 7/1927 | Schlegel et al. | 292/163 |
| 2,119,175 | | 5/1938 | Niederdrenk . | |
| 3,175,376 | * | 3/1965 | Cantwell | 292/140 |
| 4,294,089 | * | 10/1981 | Best et al. | 70/150 |
| 4,295,349 | * | 10/1981 | Wasserfaller | 70/150 |
| 4,446,707 | * | 5/1984 | Mullich et al. | 292/140 |

FOREIGN PATENT DOCUMENTS

| | | | | |
|---|---|---|---|---|
| 841912 | * | 5/1970 | (CA) | 292/140 |
| 1482332 | | 5/1967 | (FR) . | |
| 1489150 | | 7/1967 | (FR) . | |
| 486751 | | 6/1938 | (GB) . | |
| 2284445 | | 6/1995 | (GB) . | |
| 2293621 | | 4/1996 | (GB) . | |

* cited by examiner

*Primary Examiner*—Lynne H. Browne
*Assistant Examiner*—John B. Walsh
(74) *Attorney, Agent, or Firm*—Steven J. Hultquist; William A. Barrett; Marianne Fuierer

(57) ABSTRACT

The invention relates to a latch unit which includes a bolt, a housing for the bolt, guides for the bolt in the housing, a first spring for the bolt in the housing, the first spring urging the bolt in a forwards direction towards a holding position in which an end part of the bolt is outside the housing, and a slot arrangement for the bolt, the slot arrangement comprising a first part and a second part, the slot arrangement having an active condition in which the first part is engaged with the second part whereby to retain the bolt against movement in the said forwards direction, characterized by a second spring to hold the first and second parts in the active condition. It is a particular feature of the invention that the bolt has a holding position in which it can engage a keeper, a non-holding position in which it is disengaged from the keeper and a retained position in which it cannot engage the keeper and in which it is retained by the slot arrangement, the non-holding position being between the holding and retained positions. There is also provided a method of operating a latch unit according as herein defined.

14 Claims, 4 Drawing Sheets

LATCH UNIT AND ASSEMBLY, AND METHOD OF OPERATING A LATCH UNIT

FIELD OF THE INVENTION

This invention relates to a latch unit and assembly, and to a method of operating a latch unit. In particular it relates to a latch unit having a slidable bolt, typically for securing a movable panel to a fixed member, such as to a part of a frame for the panel.

In this specification, "left" and "right", "forward", "rearward" and similar geometric terms refer to parts in a typical orientation of use as shown in FIG. 1, unless otherwise specified.

BACKGROUND TO THE INVENTION

When it is desired to secure a movable panel to a fixed member such as to an upright of an outer frame member, it is known to use a sliding bolt mounted to the panel, the bolt end being fittable behind or within a keeper carried by the frame, whereby to effect the securement. The keeper typically is a plate mounted over a recessed portion of the fixed member or an apertured body secured to the fixed member. The panel typically is a hinged panel which closes perpendicularly or nearly so to the fixed member and thus to the keeper. In use the bolt is slidable between (a) a holding or forwardly extended position in which the bolt end can fit within the recess or aperture provided by the keeper whereby to secure the panel in the closed condition, and (b) a rearwardly retracted or non-holding position in which the bolt end cannot engage the keeper whereby to allow the panel to move relative to the fixed member.

Usually the bolt is mounted in a bolt housing, and is slidable between guides carried by the bolt housing. Various types of bolt and bolt assembly are known, some of which are lockable in the holding position.

One type of bolt assembly has resilient bias means for the bolt, the resilient bias means conveniently being a compression spring or a leaf spring mounted in the bolt housing, the spring urging the bolt end towards the holding position, the bolt end having a chamfer; in the condition of use the chamfer faces the keeper as the panel is being closed. As the panel is moved to its closed condition the keeper forces back the bolt against the spring and into its non-holding position, until the bolt end is aligned with the recess or aperture whereupon the spring urges the bolt into its holding position; this action is often referred to as latching, and the spring as a latch spring, whilst the bolt assemblies of which the biassed and chamfer-ended bolts form a part, are referred to herein as latch units.

One common form of latch unit is designed to be fitted to the interior surface at the rim of an inwardly opening door, such as a front door of a domestic dwelling. For simplicity, the following disclosure will refer to a latch unit for such use (rim latch); however, the latch unit of the invention can also be morticed into a door or other panel, and can be fitted to windows and other movable panels. The keeper for such latch unit will usually be formed with an aperture, sized to receive the bolt end and needing only to be affixed to the door frame or other fixed member in order to provide in the holding position a self-contained embracement of the bolt end, and for simplicity also the following disclosure will assume such a keeper.

A latch unit typically has a bolt which can be moved rearwardly (retracted) by an actuator. The actuator will often be connected at one side to a "thumb-turn" (usually the side which will be to the inside of the building in use), the thumb-turn being rotated to move the bolt from its holding to its non-holding position. At its other side the actuator will often be connected to the barrel of a lock (usually the side which will be to the outside of the building in use), so that from that side it is necessary to insert a key to retract the bolt from its holding position.

Because the bolt of a latch unit would otherwise automatically enter the keeper ("latching" action) when the door is closed, it is common to require a device to be fitted which an occupier can operate in order to permit the force of the latch spring to be over-ridden. Such device will therefore permit the bolt to be retained in its non-holding position i.e. non-latching condition, so that the occupier for instance does not need to use a key or other operating means in order to regain entry into the premises. A means to over-ride the latch spring, and to maintain the bolt away from its holding position is often referred to as a "latch-back" device.

DESCRIPTION OF THE PRIOR ART

It is known to provide a latch-back device for a rim latch, the device typically comprising a slidable plate which can be moved substantially perpendicularly to the direction of movement of an extension secured to a short latch bolt. Whilst the latch bolt is being held in its non-holding position, as by a thumb-turn, the plate can be moved into engagement with a recess or the like in the extension for the latch bolt so that thereafter the plate retains the extension and thus the latch bolt in its non-holding position. When the occupier or other person desires to re-activate the latch unit, the plate is moved to release the extension whereby to permit the latch bolt to move axially, specifically to be urged to its holding position by the latch spring.

It is possible to operate this known latch-back device with one hand, but this is difficult and often awkward to achieve, so that in practice setting the latch-back device often requires the simultaneous use of both hands, one hand to rotate and hold the thumb-turn and the other then to move the plate. In addition, the operating means for the plate is small, and can be difficult to grip so that the latch-back device may be seldom or never used by the elderly or disabled. It is believed that these known (two-handed) latch-back devices are particularly difficult to operate for those suffering from arthritis or rheumatism. The known latch back devices are not safe to use on the safety exit ("panic") doors of multi-occupier premises.

STATEMENT OF THE INVENTION

We seek to provide a latch unit having a retaining means or latch-back device which reduces or avoids the disadvantages with the known devices, and which can be simpler to operate. In particular, we seek to provide a latch unit in which the latch-back device can automatically re-set, and which can thereafter be released by one hand. We therefore seek to provide a latch unit in which the latch-back device does not require a latch-back plate or the like to be moved by the user whilst the bolt is simultaneously being held manually in a retracted position against the force of the latch spring.

According to one feature of the invention we provide a method of operating a latch unit, the latch unit having a bolt, the bolt being movable in a first direction between a holding position in which a part of the bolt projects from the housing and a non-holding position in which the said part projects less from the housing, the bolt being biassed towards the holding position, the latch unit having actuating means for moving the bolt in said first direction from its holding position to its non-holding position against said bias, the bolt having a retaining means to retain it at a position away from its holding position, characterised in that the retaining means can be activated to retain the bolt only upon further movement of the bolt in the said first direction to a position rearwards of the non-holding position.

The retaining means is automatically activated upon said further movement of the bolt in the said first direction. The retaining means is conveniently a pivoted lever, or alternatively a slidable plate or lever.

Preferably, in the non-holding position the said part does not project from the housing, perhaps being flush with a planar outer forward surface of the housing.

It is thus a feature of this invention that the bolt may be moved by the actuating means in the first direction from its holding position to its non-holding position and that only upon further or continued movement in said first direction effected by the actuating means can the retaining means be effective. In particular, we provide a method of operating a latch assembly which includes a latch unit secured to a movable panel and a keeper secured to a fixed member, the latch unit including a bolt having a bolt end, the bolt being urged by a first resilient bias means in a forward direction such that in a closed condition of the assembly the bolt end is located by the keeper in a holding condition wherein opening movement of the panel relative to the fixed member is inhibited, the bolt end being shaped so that during relative movement of the panel and fixed member towards the said closed condition of the assembly the bolt end can be moved by the keeper against the first resilient bias means rearwardly into a non-holding position in which said opening movement of the panel relative to the fixed member is not inhibited by the keeper, there being actuating means alternatively to move the bolt end into said non-holding position, and retaining means engageable with the bolt to hold the bolt against forward movement characterised by engaging the retaining means with the bolt only when said bolt is rearward of said non-holding position.

It is a feature of the invention that the retaining means is engaged with the bolt only when the bolt has been moved positively rearwards of said non-holding position, for instance direct movement as by a finger-pull from the non-holding position or indirect movement as by operation of a "panic bar" (with the bolt not pausing at the non-holding position). The retaining means is not used to secure the bolt in the non-holding position, but only in the retained position rearwardly thereof.

The bolt is slidably mounted in a housing, the housing carrying a second resilient bias means, the second resilient bias means urging the retaining means towards the bolt and into a bolt retaining condition.

Thus with the bolt end in its first holding position being held by a keeper, the bolt may then be moved from that holding position to its non-holding position (as by a thumb-turn), but the (retracted) bolt position reached following this movement of the bolt is not sufficient either to activate the retaining means or to permit the retaining means to be activated i.e. a further movement of the bolt by means of a further (partial) rotation of e.g. the thumb-turn, is required. In an alternative embodiment suited to operation by a panic button or bar, the bolt can be moved directly to the retained position i.e. through and beyond the non-holding position suited for normal panel (typically an exit door for a multi-occupier building) opening and closing.

The bolt may simply be a latching bolt but preferably is securable in the holding position to provide a combination latch bolt and locking bolt.

According to another feature of the invention, we provide a latch unit which includes a bolt, a housing for the bolt, guides for the bolt in the housing, first resilient bias means for the bolt in the housing, the first resilient bias means urging one end of the bolt in a forwards direction towards a holding position externally of the housing, and retaining means for the bolt, the retaining means having an inactive position in which the bolt is free to move relative to its guides and an active position in which the retaining means provides a holding action whereby to retain the bolt against movement in the said direction, characterised in that the retaining means is resiliently biassed towards its active condition.

According to a further feature on the invention, we provide a latch unit which includes a bolt, a housing for the bolt, guides for the bolt in the housing, first resilient bias means for the bolt in the housing, the first resilient bias means urging one end of the bolt in a forwards direction towards a holding position externally of the housing, and retaining means to provide a holding action whereby to retain the bolt against movement in the said direction, characterised in that the retaining means comprises a peg and slot arrangement, and in that a second resilient bias means effects engagement between the peg and slot to permit said holding action.

The peg and slot are arranged such that the retaining means holds the said one end of the bolt rearwards of the non-holding position reached by the bolt end when pushed back by a keeper during latching i.e. in the latch back position.

Preferably, the slot is carried by a lever. The second resilient bias means acts against one of the said peg and lever. A disengaging means can be urged against said one of said peg and slotted lever to overcome said second resilient bias means whereby to permit the bolt to be urged towards the holding position by the first resilient bias means.

Preferably, the disengaging means is an extension of the lever, the disengaging means projecting externally of the housing. Preferably the slot is in a movable lever and the peg is carried by the bolt. Desirably, the slot is connected to a second slot, the peg being movable along said second slot by said first resilient bias means when said second resilient bias means has been overcome by the disengaging means whereby the bolt end is moved into said holding position by the first resilient bias means.

Usefully, the second slot has a ramp portion; usefully the first resilient bias means also holds said peg and ramp portion in engagement.

We also provide a latch assembly which includes a movable panel and a fixed member, the panel having mounted thereto a latch unit as herein defined and the fixed member having mounted thereto a keeper for said one end of the bolt, the one end being locatable by said keeper whereby to secure the panel and the fixed member against relative movement, the one end being retainable by the retaining means at a position away from the keeper and away from the non-holding position whereby to permit relative movement between the panel and the fixed member.

Accordingly, when the assembly is correctly fitted, the bolt has three positions, a (forward) holding position in which it can engage the keeper, a (rearward) non-holding position in which it cannot engage the keeper, and a (more rearward) retained "latch back" position in which it cannot engage the keeper and in which it is retained by the retaining means. When used to hold open an emergency exit door when operated by a panic control, the bolt may be passed through the non-holding position without dwelling i.e. without the bolt having a stationary intermediate position.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
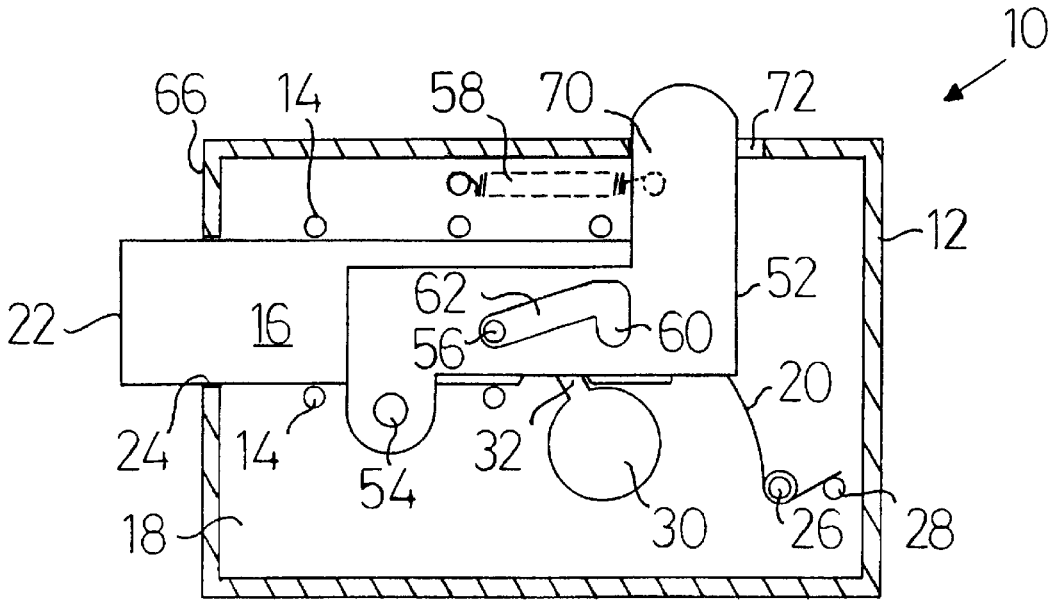
FIG. 1 is a side view of a latch unit according to the invention, partly in section, the bolt being in its holding position.

The latch unit 10 of FIG. 1 comprises a rigid, preferably metallic, housing 12, which carries guides 14 for an axially-extending rigid (preferably metal) bolt 16. In this embodiment the guides 14 comprise a number of spaced posts upstanding from housing base 18, but in alternative embodiments the guides could be parallel upstanding rails, or a combination of posts and rails.

Figure 2:
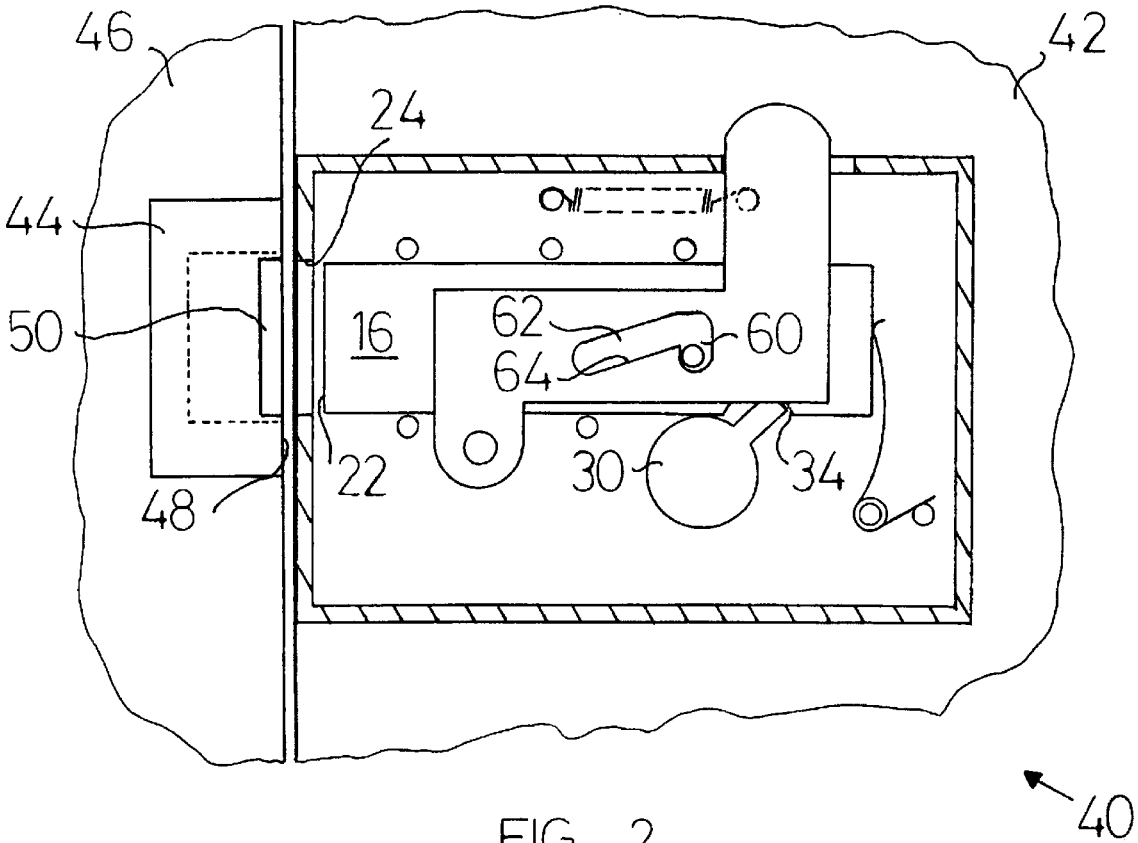
FIG. 2 is a side view of the latch assembly including the unit of FIG. 1, the bolt being in the retained position.

Bolt 16 has a holding position (FIG. 1), and intermediate non-holding position (similar to that of FIG. 3), and a retained position (FIG. 2).

The bolt 16 is biassed leftwards by first or latch spring 20, as shown in FIG. 1 into its holding position in which the bolt end 22 extends from the housing 12, through housing bolt opening 24, sufficient to engage in or behind a keeper. The latch spring 20 is coiled around upstanding post 26 and one end acts against post 28. In an alternative embodiment the latch spring is a coil spring as in the embodiments of FIGS. 4 and 7.

The latch unit 10 includes an actuator 30 for the bolt, the actuator having an arm 32 which is engageable with a (rear) surface 34 of a recess in the bolt such that clockwise rotation (as viewed) of the actuator causes rearward axial retraction movement of the bolt 16 in a first direction against latch spring 20; anti-clockwise rotation of actuator 30 subsequently allows the latch spring 20 to effect forward movement of the bolt 16 to the holding position. In a typical rim latch secured to the inner face of an external door of a building, one side of the actuator will be connected to the barrel of a lock, so that the actuator can only be key-rotated from that side—usually the side which will face outwardly of the building; the other side (inside the building) of the actuator will typically be connected to a thumb-turn or the like. Neither the lock barrel nor thumb-turn are shown in the drawings, since suitable embodiments are well known to and widely used by those skilled in this art.

In use as a latch assembly 40 as shown in FIG. 2, housing 12 is fixed to a door 42 whilst keeper 44 is fixed to a frame member 46 for the door. The bolt 16 is movable by arm 32 from its holding position as shown in FIG. 1 rightwards to its non-holding position in which the bolt end 22 can pass the keeper edge 48, so that the door 42 can be opened or closed.

It will be understood that one face of the bolt end 22 is chamfered, in known fashion. In the embodiment shown in FIGS. 1 and 2 the latch unit is designed to be held in the closed condition following latch unit movement in the direction into the paper, so that it is the unseen face of the bolt end 22 which is chamfered. It will also be understood that when the latch unit 10 is moved towards its "closed" condition against keeper 44, the bolt end 22 is first forced back to its non-holding position against the force of latch spring 20 before returning forwardly to its holding position when bolt end 22 becomes aligned with the keeper aperture. The keeper has a ramp 50 to cooperate with the chamfer of the bolt end 22, to assist the rearwards movement before the forwards latching action.

In accordance with one aspect of the invention the latch unit 10 also includes a lever 52 which pivots about fixed housing post 54. The bolt 16 carries a peg 56. The lever 52 is biassed (anti-clockwise) into the position shown in FIGS. 1 and 2 by second or retainer spring 58. The lever 52 has a first slot 60 which is connected to a second slot 62, both slots 60,62 being sized to accommodate the peg 56.

In the holding position of FIG. 1, the peg 56 is adjacent the forward edge of the second slot 62 (the peg 56 and the forward edge of second slot 62 thus together determining the holding position of the bolt); rearward (i.e. rightward as drawn) axial retraction movement of the bolt 16 between guides 14 (as by clockwise rotation of actuator 30 or engagement of bolt end 22 with keeper 44) causes relative movement between the peg 56 and second slot 62.

During the initial relative movement between the peg 56 and second slot 62 the peg 56 is moved along slot ramp surface 64 causing the lever 52 to pivot clockwise, extending and tensioning the retainer (coil) spring 58 and holding peg 56 and ramp surface 64 in engagement; in an alternative embodiment the spring 58 could be a leaf spring or equivalent e.g. a torsion spring. This initial movement continues until the bolt end 22 reaches the non-holding position, and thus will encompass the normal movement range of the bolt during its latching action.

In accordance with a feature of the invention, the actuator 30 can be rotated (clockwise as viewed) to effect further axial movement of the bolt 16 in the rearward direction, beyond the non-holding position. The peg 56 is thereby moved into alignment with lever first slot 60, with retainer spring 58 then acting to pivot lever 52 anti-clockwise whereby to locate peg 56 in first slot 60; with the peg 56 so located the bolt 16 is held in its retained or latch-back position.

Ramp surface 64 is longer than the distance moved by the bolt end between the non-holding position and the holding position, i.e. further rearward movement of bolt 22 is required from the non-holding position to reach the retained or bolt latch-back position.

It will thus be understood that when the bolt 16 is moved to its non-holding position (in which the bolt end 22 can pass the keeper edge 48, i.e. the bolt end 22 is flush or substantially flush with the housing face 66), the peg 56 is (only) part-way up the ramp portion 64, and that such rearward retraction movement of the bolt to its non-holding position can be by way of either the actuator or by the bolt 16 engaging its keeper 44 during door closure. It will also be understood that further movement of the bolt 16 is necessary before the retaining means is activated, i.e. before the peg 56 has completed its movement up ramp portion 64 and entered and lodged in first slot 60 whereby to provide the latch-back condition. Thus, in the retained latch-back condition of the bolt shown in FIG. 2, the bolt end 22 is within the housing 12, in a position into which it can only be driven rearwardly by the actuator 30, not by the keeper 44.

As a further feature of the invention lever 52 has an extension 70. In this embodiment (a) extension 70 is generally parallel to first slot 60, (b) second coil spring 58 is connected to extension 70, and (c) housing 12 has an opening 72 through which a terminal portion of extension 70 projects so as to form a "finger-press". Thus in use, the latch-back can be released or de-activated by (downwards) finger pressure on extension 70, to pivot lever 52 until peg 56 is aligned with second slot 62 whereupon latch spring 20 can move bolt 22 forwards either until surface 34 of the bolt recess (FIG. 2) abuts arm 32, or (if actuator 30 has already been rotated fully anti-clockwise, or is free to be driven anti-clockwise by the bias of latch spring 20) until the peg 56 engages the forward end of the second slot 62.

In an alternative embodiment the extension 70 is connected to a hoop by way of a cord or chain, the hoop being operable to move the lever 52 in the direction to de-activate the latch-back device, useful for someone unable to apply sufficient single-finger pressure to extension 70 but who can apply the weight of their arm. In addition, a rod may be connected directly to the bolt 16, which rod extends through the rear wall of the housing; the rod can be shaped so as to be more easily grasped and pulled than the grasping and rotating of a thumb turn, so facilitating the use of the latch unit especially by the elderly or infirm.

Although we prefer that the peg be carried by the bolt and that the slots are within the lever, we do envisage that the slots could be replaced by depressions and that the depressions could alternatively be in the bolt (with the peg on the lever).

In one embodiment the peg 56 stands slightly proud of the lever 52 and provides a column upon which a guide roof for the bolt rests, so that the bolt is in part being guided between the housing base 18 and this guide roof, as well as between upstanding posts 14; in an alternative embodiment a removable cover (similar to cover 76 of FIG. 5) for the bolt housing provides the guide roof.

Figure 3:
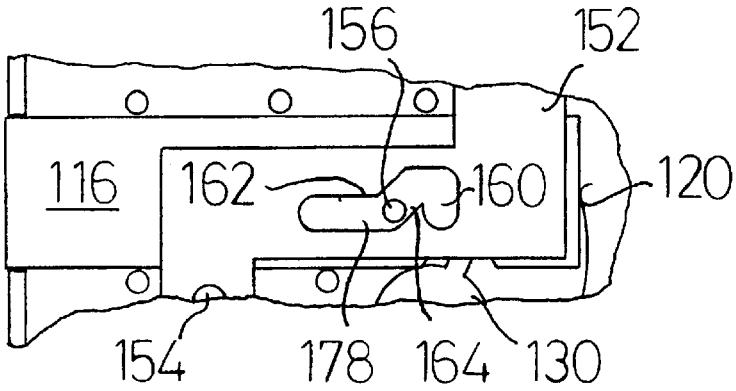
FIG. 3 is a side view of part of an alternative latch unit, the bolt being in the non-holding position.

In the alternative embodiment of FIG. 3, the second slot 162 has a ramped portion 164 and a forward portion 178 which is substantially parallel to the longitudinal axis of bolt 116. Whilst the bolt 116 moves between its holding position and its non-holding position as shown, the peg 156 moves along the forward portion 178. The resistance to such movement is provided only by the latch spring 120. When it is desired to move the bolt to its retained position, further rearwards movement by the actuator 130 causes the peg to move along ramped portion 164 (pivoting lever 152) and into first slot 160 as described in relation to FIGS. 1 and 2. Resistance to such further movement is provided both by the latch spring 120 and also by the retainer spring (not shown in this figure). It can be arranged that there is a noticeable or significant increase in resistance when it is desired to move the bolt 116 into its retained position, so that it is less likely that the bolt will be further moved to its retained position when this is not desired. Alternatively stated, with the embodiment of FIG. 3 it will be apparent to the user (from the sudden increase in the retraction force which has to be applied to the bolt) when the bolt is being moved from its non-holding poisition and towards its retained position (in which position the door is openable freely by the occupier and intruders alike), i.e. so that the retained position is less likely to be adopted inadvertently.

This embodiment also permits the retainer spring (not shown in FIG. 3) to be untensioned or under minimum tension during the latching action, (i.e. as compared to the embodiment of FIGS. 1 and 2 it is only necessary to tension the retainer spring of the FIG. 3 embodiment whilst the bolt is being "further" moved to its retained position); this will likely result in an extended life for the retainer spring. In addition, this embodiment minimises wear and frictional resistance between the peg 156 and the ramp portion 164 and also between the lever 152 and pivot post 154, over the traverse of the bolt 116 during its latching action i.e. between the holding and non-holding positions. Furthermore, during latching movement the extension (not shown in FIG. 3, but similar to the extension 70 of FIG. 1) is not moved e.g. inwardly of the housing, but in contrast during further movement of the latch bolt 116 in this first direction towards the latch-back position the extension is moved inwards relative to the housing noticeably (by the ramped portion 164) before snapping out again when the peg 156 enters the first slot 160, so that a visual indication of the activation of the retaining means is also provided.

Figure 4:
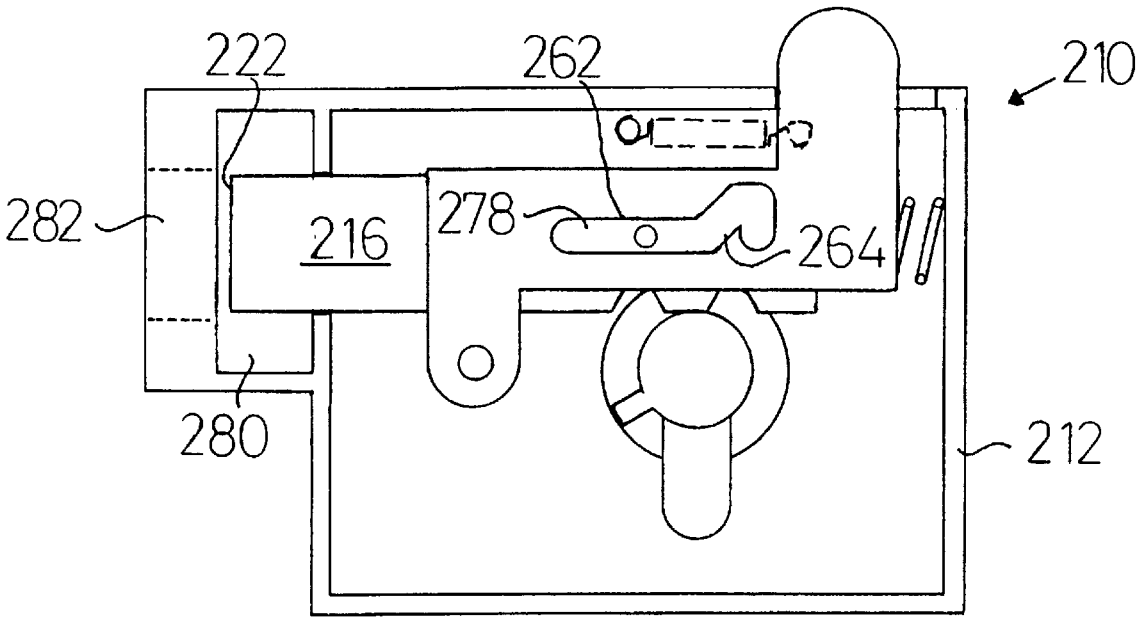
FIG. 4 is a side view of another alternative latch unit.

The arrangement of FIG. 4 is somewhat similar to that of FIG. 3, in that the second slot 262 has a ramped portion 264 and also a forward portion 278 which is generally parallel to the longitudinal axis of bolt 216. However, the latch unit 210 shown in FIG. 4 is adapted to cooperate with an open ended keeper (not shown) which can enter aperture 280 between the housing 212 and a receptor 282. Bolt 216 has a first holding position (as shown), and a second holding position in which the bolt end 222 enters receptor 282. The receptor 282 acts as a second keeper, and is carried by the housing 112—as generally described in our copending international patent application PCT/GB96/01530, the disclosure of which is incorporated herein by reference.

Figure 5:
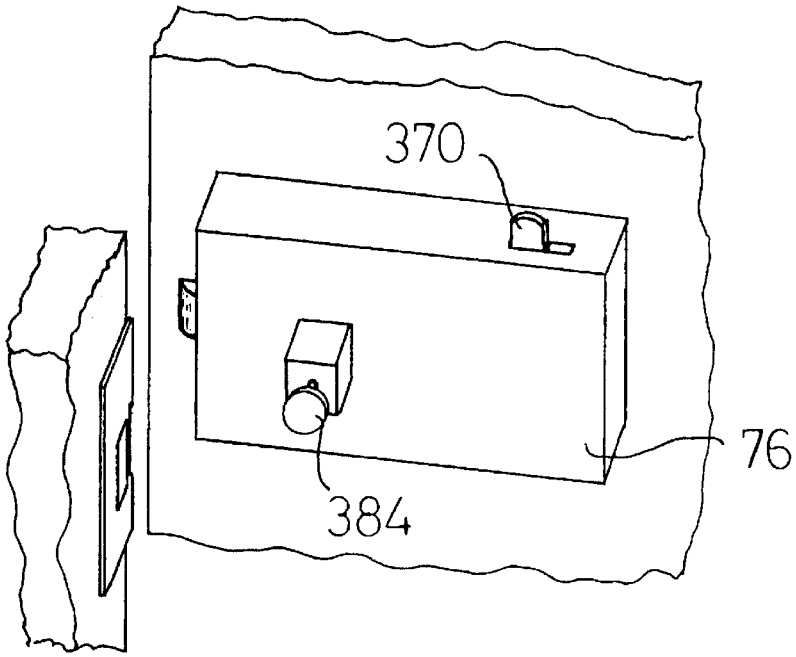
FIG. 5 is a perspective view of a latch assembly including a further alternative embodiment of latch unit.
Figure 6:
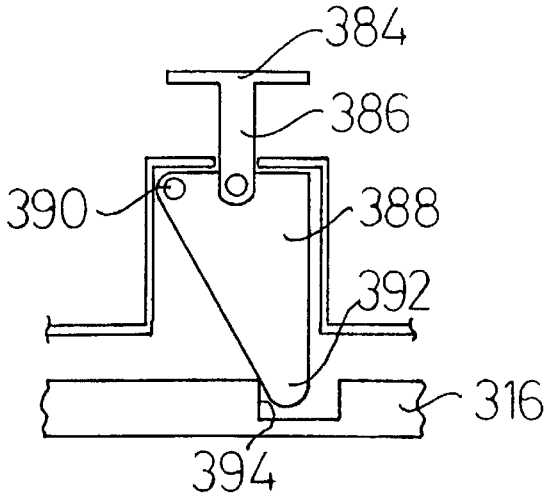
FIG. 6 is a sectional view of part of the latch unit of FIG. 5.
Figure 7:
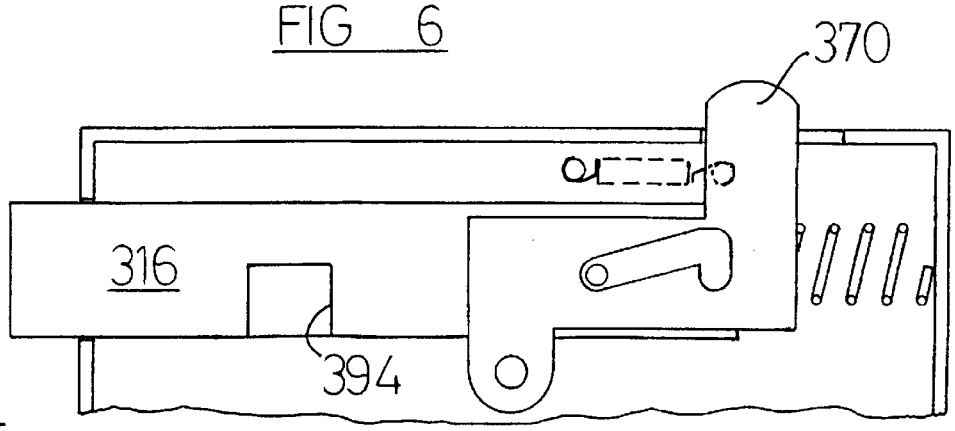
FIG. 7 is another sectional view of the latch unit of FIG. 5.

The advantageous embodiment of FIGS. 5–7 shows a latch unit for use as a "panic" bolt e.g. for use on an emergency exit door, in which a button 384 can be pressed to move the bolt 316 rearwardly from its holding position directly to its retained position (by way of and past its non-holding position). In the orientation of FIGS. 5 and 7, rearward movement of the bolt is towards the right as drawn, whilst in the orientation of FIG. 6, rearward movement of the bolt is towards the left as drawn.

In this embodiment the button 384 is mounted on a rod 386 which is pivotably attached to a pivot plate 388. Pivot plate 388 is mounted upon fixed pivot 390, and has an end 392 which engages abutment surface 394 of the bolt 316. A particular advantage of this arrangement is that a user of the panic bolt can (and in a panic usually will) move the bolt 316 in one movement to the latch-back position, ensuring that the door remains unlatched and so openable by rescuers from outside. This contrasts with the disadvantage of prior art panic bolts which automatically re-latch if allowed to close (so that a person still inside the building who has been overcome by fumes or who is otherwise unable themselves to operate the panic bolt to re-open the door is isolated from rescuers outside the building, and can thus be trapped inside). For subsequent normal use, the bolt can be re-set quickly and simply to the normal latching condition by depression of the finger press 370 or equivalent.

It will be understood that the button 384 can be replaced by a pivoting plate, sometimes referred to as a "paddle", or equivalent operating member.

Figure 8:
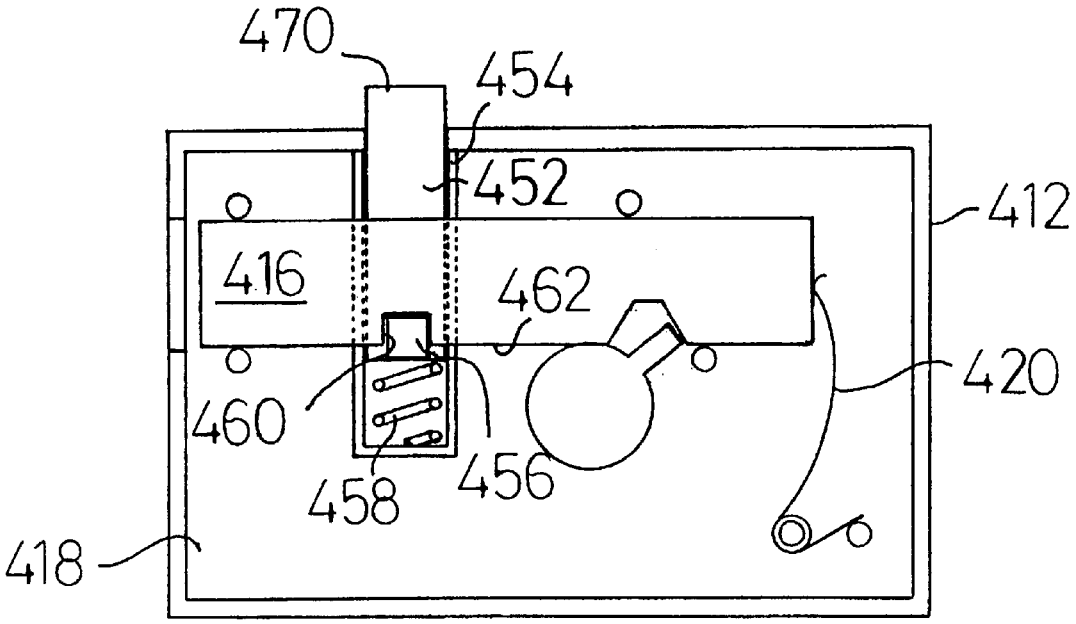
FIG. 8 is a side view of part of yet another alternative embodiment of latch unit.

In the embodiment of FIG. 8, the retaining means is slidable, and comprises a plate 452 slidable between guides 454. The bolt 416 has a recess 460 which can accommodate a peg 456 carried by the retaining plate 452. Retaining plate 452 is biassed upwardly as drawn by coil spring 458. As the bolt 416 is moved between its holding and non-holding positions, the peg 456 runs along the bottom edge 462 of the bolt, with the spring 458 under compression; when the bolt is moved back to its retained position as shown, the retainer spring 458 urges the peg 456 into the recess 460. Thereafter, depression of the plate extension 470 (as by finger pressure) can release the peg 456 from the recess, permitting the latch spring 420 to urge the bolt 416 towards its holding position.

In this embodiment, the retaining plate 452 lies between the bolt 416 and the base 418 of the housing 412, so that the bolt 416 is spaced from the base 418 by the thickness of the retaining plate 452 and the corresponding depth of the guides 454; in an alternative embodiment the retaining plate lies between the bolt 416 and the cover (not shown).

An advantage of the constructions described is that the bolt 16,116,216,316,416 can be of substantially constant dimensions throughout its length, and its part within the latch housing need not (as in some known latch unit constructions) be of reduced dimensions (and thus of reduced strength against attempted unlawful entry). The reduced dimensions of these prior art latch-back retaining members may be necessary so that they can be accommodated within their respective housings.

What is claimed is:

1. A latch unit which includes a bolt, a housing for the bolt, guide means for the bolt in the housing, first resilient bias means for the bolt in the housing, the first resilient bias means urging the bolt in a forwards direction towards a holding position in which an end part of the bolt is outside the housing, and retaining means for retaining the bolt in a retained position against movement in said forwards direction, the retained position being spaced from the holding position, the retaining means comprising a first part and a second part, the retaining means having an active condition in which the first part is engaged with the second part whereby to retain the bolt, second resilient bias means to hold the first and second parts in the active condition, characterized in that the second resilient bias means acts to resist movement of the bolt to the retained position.

2. A latch unit according to claim 1 characterized in that one of the first part and second part of the retaining means is carried by one of: a pivoted lever; a slidable plate; and a slidable lever.

3. A latch unit according to claim 1 characterized in that the first part is a peg and the second part is a slot, whereby the retaining means comprises a peg and slot arrangement.

4. A latch unit according to claim 1 characterized in that the bolt can be secured in the holding position whereby to provide a combination latch bolt and locking bolt.

5. A latch assembly which includes a moveable panel and a fixed member, the panel having mounted thereto a latch unit according to claim 1 and the fixed member having mounted thereto a keeper for said end part of the bolt, the bolt having {i} a holding position in which it can engage the keeper when the panel is in a closed condition with the end part and keeper in alignment {ii} a non-holding position in which it is disengaged from the keeper, and {iii} a retained position in which it cannot engage the keeper and in which it is retained by the retaining means, the non-holding position being between the holding and retained positions.

6. A latch assembly according to claim 5 characterized in that in the non-holding position said end part is substantially flush with an outer surface of the housing, and in that in the retained position said end part is within the housing.

7. A latch unit according to claim 1, the bolt being movable in a rearwards direction between a holding position in which the end part of the bolt projects from the housing and a non-holding position rearward of the holding position, the latch unit having actuating means for moving the bolt in said rearwards direction from its holding position to its non-holding position against said first resilient bias means, the non-holding position being between the holding position and the retained position so that further movement of the bolt in the rearwards direction to a position beyond the non-holding position is required to attain the retained position.

8. A latch unit according to claim 7 in which the second resilient bias means acts to resist movement of the bolt between its non-holding and retained positions, but does not act to resist movement of the bolt between its holding and non-holding positions.

9. A latch unit according to claim 1 characterized in that the retaining means is automatically activated upon movement of the bolt into the retained position.

10. A latch unit according to claim 1 characterised in that the retaining means is automatically activated upon movement of the bolt into the retained position.

11. A latch unit which includes a bolt, a housing for the bolt, guide means for the bolt in the housing, first resilient bias means for the bolt in the housing, the first resilient bias means urging the bolt in a forwards direction towards a holding position in which an end part of the bolt is outside the housing, retaining means for retaining the bolt in a retained position against movement in said forwards direction, the retained position being spaced from the holding position, the retaining means comprising a peg and a slot, the retaining means having an active condition in which the peg is engaged with a part of the slot whereby to retain the bolt, second resilient bias means to hold the peg and slot in the active condition, the second resilient bias means acting to resist movement of the bolt to its retained position, wherein the peg is carried by the bolt and the slot is formed in a movable lever, and wherein a disengaging means can be operated to move the lever whereby to overcome said second resilient bias means and disengage the peg from said part of the slot so as to permit said end part of the bolt to be urged towards the holding position by the first resilient bias means.

12. A latch unit according to claim 11 characterized in that the disengaging means is an extension of the lever, said extension projecting from the housing.

13. A latch unit according to claim 11 characterized in that the slot is a continuation of a second slot, the peg being movable along said second slot by said first resilient bias means when said first part and said second part are disengaged whereupon said end part is moveable into said holding position by the first resilient bias means.

14. A latch unit according to claim 13 characterized in that the second slot has a ramp portion, and in that the first resilient bias means can act to hold said peg in engagement with said ramp portion.

* * * * *

UNITED STATES PATENT AND TRADEMARK OFFICE

CERTIFICATE OF CORRECTION

PATENT NO. : 6,199,922 B1
DATED : March 13, 2001
INVENTOR(S) : Anthony Wilfred Kibble It is certified that error appears in the above-identified patent and that said Letters Patent is hereby corrected as shown below:

Column 10,
Lines 25-27, delete Claim 10.
Line 28, change "11" to -- 10 --.
Line 49, change "12" to -- 11 --, and change "11" to -- 10 --.
Line 52, change "13" to -- 12 --, and change "11" to -- 10 --.
Line 58, change "14" to -- 13 --, and change "13" to -- 12 --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*